United States Patent [19]

Alperson

[11] Patent Number: 4,860,984

[45] Date of Patent: Aug. 29, 1989

[54] HEIGHT-EXTENDER ADAPTER FOR RETAILING DISPLAY BRACKETS

[76] Inventor: Joel H. Alperson, 3306 South 157th St., Omaha, Nebr. 68130

[21] Appl. No.: 279,870

[22] Filed: Dec. 5, 1988

[51] Int. Cl.[4] ..... A47F 5/08

[52] U.S. Cl. ..... 248/225.2; 248/215; 248/340; 211/87

[58] Field of Search ..... 248/225.2, 227.2, 220.3, 248/225.1, 215, 340, 359 G, 359 I; 211/87

[56] References Cited

U.S. PATENT DOCUMENTS

| | | | |
|---|---|---|---|
| 2,150,826 | 3/1979 | Gill | 248/215 |
| 4,340,144 | 7/1982 | Cousins | 248/222.2 X |
| 4,518,025 | 5/1985 | Judkins | 248/340 X |
| 4,579,308 | 4/1986 | Jensen | 248/225.1 |
| 4,694,965 | 9/1987 | Parnell | 248/222.2 X |

FOREIGN PATENT DOCUMENTS

| | | | |
|---|---|---|---|
| 1556696 | 12/1968 | France | 248/359 G |
| 292351 | 12/1953 | Switzerland | 248/359 G |

*Primary Examiner*—Alvin C. Chin-Shue

*Attorney, Agent, or Firm*—George R. Nimmer

[57] ABSTRACT

Conventional retailing display brackets having a single-offset-anchor portion are self-secureable to internally horizontally slotted upright panels. To adapt such brackets for similar self-secureable engagement to latticed panels, the present invention provides a height-extender adapter clip that is securely slideably mountable to the bracket's single-offset-anchor portion. The height-extender adapter is fabricated by strategically joining a laminar front-plate to a hooked rear-plate, and which plates are specially contoured for slideably bearing against selected areas of the bracket's single-offset-anchor portion.

4 Claims, 1 Drawing Sheet

HEIGHT-EXTENDER ADAPTER FOR RETAILING DISPLAY BRACKETS

BACKGROUND OF THE INVENTION

Drawing FIGS. 1 and 2 (at solid lines) are side elevational and front elevational views, respectively, of a conventional retailing display bracket "B" comprising an elongate arm portion 200 having its rearward aft-end 201 attached to the upright lower-length 102 of the bracket laminar anchor portion 100. Arm 200, which extends rigidly forwardly and downwardly from anchor lower-length 102, has a forward free-end 202. Arm topside 203 is provided with a plurality of spaced knobs 204 that can serve to separate garment hangers (not shown). Laminar anchor 100 has an upper-end 105 and a lower-end 101, and has a pair of linearly generated and substantially parallel surfaces respectively extending between said ends 101 and 105 i.e. frontal-surface 100F and rear-surface 100R. Anchor 100 has an upright upper-length 104 that is rearwardly offset from said lower-length 102 by virtue of substantially horizontal web-length 103. Accordingly, such anchors (100) are aptly termed "single-offset-anchors".

The phantom lines of FIGS. 1 and 2 refer to side elevational and front elevational views, respectively, of upright wall paneling "P" having an upright planar surface "PF" and a plurality of vertically spaced T-shaped slots "T" intersecting surface "PF" at "TF". Brackets "B" can be installed to paneling "P" by inserting anchor upper-length 104 into a slot "T" whereby anchor lower-length 102 is rearwardly abuttable against paneling frontal surface "PF". Accordingly, by virtue of the paneling underlying support for anchor web-length. 103 and the weighty bracket arm 200, anchor lengths 102 and 104 are urged in opposite angular direction, and bracket "B" is self-secured to paneling "P" i.e. without using separate mechanical fasteners.

For aesthetic and other reasons, retailers are preferring to replace their T-slotted paneling "P" with latticed paneling "L" alluded to in FIG. 3. However, because of the circular cross-sectional shape for the paneling horizontal bars "LA", and the generous vertical spacing "LV" between bars "LA", retailers cannot employ their single-offset-anchor brackets ("B") with the increasingly popular latticed paneling ("L").

GENERAL OBJECTIVE OF THE INVENTION

It is the general objective of the present invention to provide a readily attachable, reliable, and economical adapter that will permit utilization of conventional single-offset-anchor type retailing display brackets with latticed paneling.

GENERAL STATEMENT OF THE INVENTION

With the above general objective in view, and together with other ancillary and specific objectives which will become more apparent as this description proceeds, the adapter concept of the present invention takes the form of a height-extender clip that can securely slideably engage a retailing display bracket of the single-offset-anchor type whereby the resultant combination is readily installable to latticed paneling without separate mechanical fasteners. The slideably engageable height-extender adapter comprises a laminar rear-plate having a lower-region bearing against the display anchor rear-surface at least at the web-length and upper-length and having an inverted-U upper-region that forwardly terminates as a frontal-leg hook, and further comprises a laminar front-plate having a lower-realm bearing against the display anchor front-surface at least at the upper-length and having an upper-realm attached to the rear-plate upper-region above the lower terminus of the frontal-leg hook.

BRIEF DESCRIPTION OF THE DRAWING

In the drawing, wherein like characters refer to like parts in the several views, and in which.

DETAILED DESCRIPTION OF THE DRAWING

Figure 1:
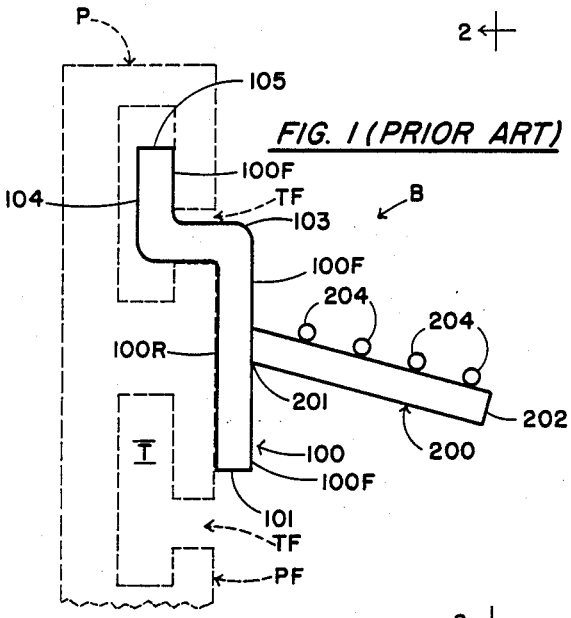
FIG. 1 (PRIOR ART)
FIGS. 1 and 2, aforedescribed, are side elevational and front elevational views, respectively of a conventional garment retailing bracket.
Figure 2:
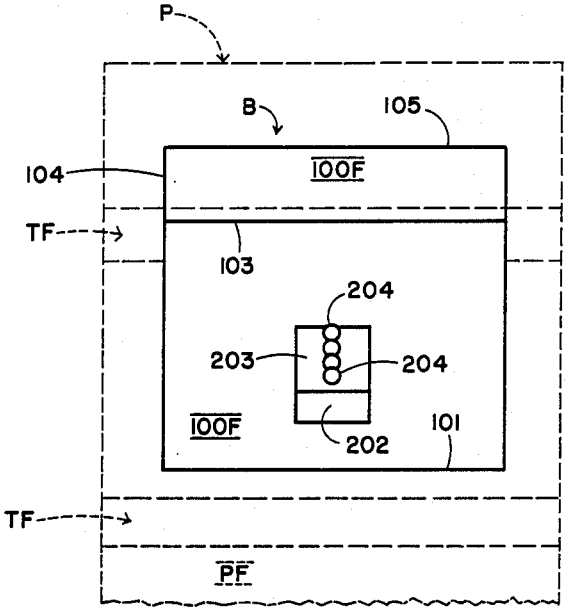
FIG. 2 (PRIOR ART)
Figure 4:
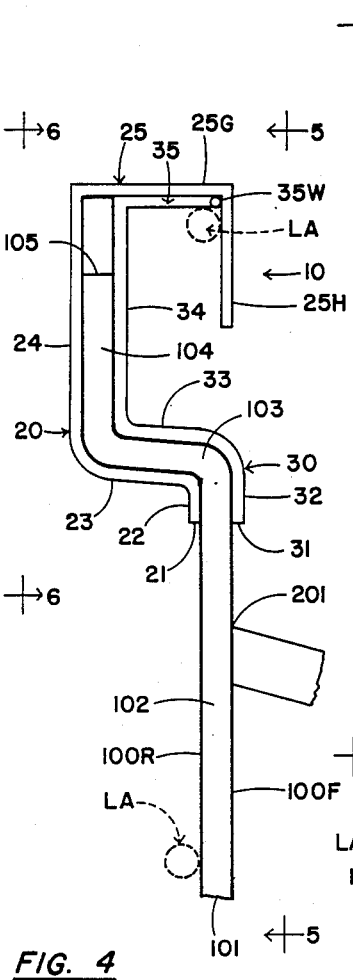
FIG. 4 is a side elevational view of a representative embodiment of the height-extender clip adapter of the present invention and shown in slideably engaged combination with the FIGS. 1–2 retailing display bracket and self-secured to the FIG. 3 latticed paneling.

Representative embodiment 10 of the height-extender clip adapter of the present invention generally comprises a laminar rear-plate 20 having a lower-region (e.g. 23–24) bearing against display anchor rear-surface 100R at least at the web-length 103 and upper-length 104 and having an inverted-U upper-region 25 that forwardly terminates as a frontal-leg hook 25H, and further comprises a laminar front-plate 30 having a lower-realm (e.g. 34) bearing against display anchor front-surface 100F at least at said upper-length 104 and having an upper-realm 35 attached (e.g. 35W) to the rear-plate upper-region (e.g. at 25G) above and rearwardly of the lower terminus of frontal-leg 25H. Laminar plates 20 and 30, which respectively slideably engage anchor 100, are readily manufacturable by selectable processes such as: molding or extruding metallic or resinous structural materials; permanently bending rectangular metallic pieces; etc.

The lower extremities (21, 31) for rear-plate 20 and front-plate 30 are preferably substantially co-elevational immediately below aanchor web-length 103 whereby the entire height-extender (10) is located nearer to the upper-end (105) than to the lower-end (105) than to the lower-end (101) of the single-offset-anchor 100.

The preferred rear-plate (20):

for its lower-region includes parts 22, 23, and 24, bearing against anchor rear-surface 100R at parts 102, 103, and 104, respectively; and for its upper-region 25 includes a horizontally extending roof 25G and a vertically extending frontal-leg hook 25H that provides the height-extender forward extremity.

The preferred front-plate (30):

for its lower-realm includes parts 32, 33, and 34, bearing against anchor frontal-surface 100F at parts 102, 103, and 104, respectively; and for its upper-realm includes a horizontally extender upper terminus (35) that upwardly abuts and is attached to (e.g. welding 35W) rear-plate roof 25G.

Figure 5:
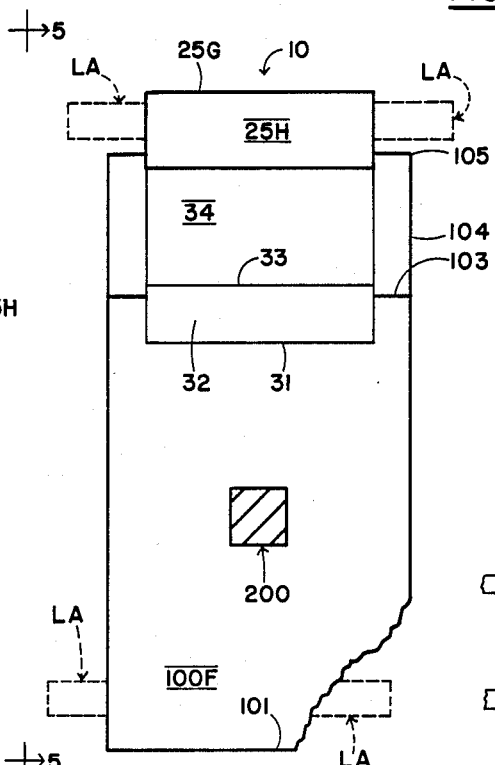
FIG. 5 is a frontal elevational view of the FIG. 4 combination and as seen in the direction of line 5—5 of FIG. 4.
Figure 6:
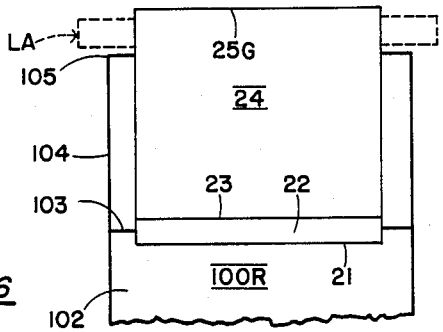
FIG. 6 is a rearward elevational view of the FIG. 4 combination and as seen in the direction of line 6—6 of FIG. 4.
Figure 3:
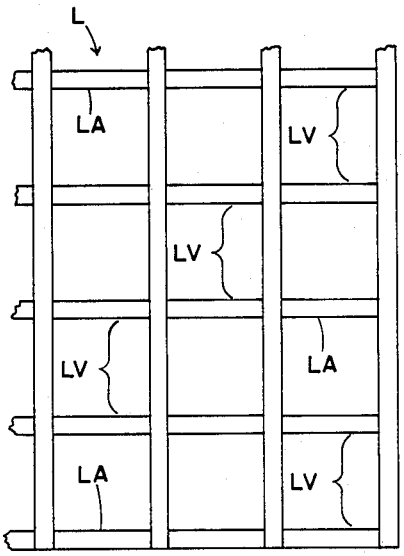
FIG. 3 (PRIOR ART)
FIG. 3 is a front elevational view of latticed paneling that can serve as mounting environment for the height-extender clip and retailing display bracket combination of the present invention.

When the rear-plate (20) and front-plate (30) are joined together (e.g. 35W), there is provided a height-extender clip adapter 10 that will readily slideably engage a single-offset-anchor e.g. by sliding in the horizontal directions of FIGS. 5 and 6. Because such adapter (10) has an overall-height (101–35) that exceeds the anchor-height (101–105) and has also provided a frontal hook (25H), the anchor and adapter combination (100, 10) is readily self-securable to latticed paneling ("L"). And more specifically: because the overall-height (101–35) exceeds bars spacing "LV", and frontal-leg 25H is hookable over a lattice bar "LA", the rear-surface 100R of suspended anchor 100 can abut the next lower bar "LA" to provide a removably self-secureable engagement to latticed paneling "L" and without the necessity for ancillary fasteners, adhesives, etc.

From the foregoing, the construction and operation of the height-extender adapter for retailing display brackets will be readily understood and further explanation is believed to be unnecessary. However, since numerous modifications and changes in the height-extender adapter will readily occur to those skilled in the art, it is not desired to limit the invention to the exact construction shown and described, and accordingly, all suitable modifications and equivalents may be resorted to, falling within the scope of the appended claims.

I claim:

1. In combination with a retailing display bracket comprising an elongate arm portion having an aft-end attached to a upright lower-length of a bracket laminar anchor portion, said anchor portion having an upper-end and a lower-end, having a frontal-surface extending between upper-end and lower-end, and having substantially parallel to said frontal-surface a rear-surface extending between upper-end and lower-end, and further comprising an upright upper-length rearwardly offset from said lower-length by virtue of a substantially horizontal web-length, the improvement of a height-extender securely slidably engaging said retailing bracket laminar anchor portion and said height-extender comprising:

(A) a rear-plate comprising:

(Ai) a lower-region bearing against the anchor portion rear-surface at upper portions of the lower-length, at the web-length, and along the entire upper-length, and (Aii) an inverted-U upper-region overlying the anchor portion upper-end and forwardly terminating as a downwardly extending frontal-leg; and (B) a front-plate comprising:

(Bi) a lower-realm bearing against the anchor portion frontal-surface at upper portions of the lower-length, the web-length, and at the anchor portion upper-length, and (Bii) an upper-realm relegated wholly rearwardly of said frontal-leg and being attached to the rear-plate upper-region at an elevation above the anchor portion upper-end.

2. The combination of claim 1 wherein the rear-plate and front-plate are laminar structures; and wherein the entire height-extender is located nearer to the anchor portion upper-end than to the lower-end thereof.

3. The combination of claim 1 wherein the rear-plate inverted-U upper-region includes a horizontally extending roof and a vertically extending frontal-leg; and wherein the front-plate upper-realm includes a horizontally extending upper terminus that abuts and is attached to said roof.

4. In combination with a retailing display bracket comprising an elongate arm portion having an aft-end attached to upright lower-length of a bracket laminar anchor portion, said anchor portion having an upper-end and a lower-end, having a frontal-surface extending between upper-end and lower-end, and having substantially parallel to said frontal-surface a rear-surface extending between upper-end and lower-end, and further comprising an upright upper-length rearwardly offset from said lower-length by a substantially horizontal web-length, the improvement of a height-extender securely slideably engaging said retailing bracket laminar anchor portion and said height-extender comprising a pair of laminar plates wherein:

(A) one of said plates being a rear-plate comprising:

(Ai) a lower-region bearing against the anchor portion rear-surface at upper portions of the lower-length, at the web-length, and along the entire upper-length, and (Aii) an upper-region including a generally horizontally extending roof overlying the anchor portion upper-end;

(B) one of said plates being a front-plate comprising:

(Bi) a lower-realm bearing against the anchor portion frontal-surface at upper portions of the lower-length, the web-length, and at the anchor portion upper-length, and (Bii) an upper-realm attached to said roof; and (C) at least one of said laminar plates having a downwardly extending frontal-leg that provides the forward extremity of said height-extender.

* * * * *